US011938386B2

(12) United States Patent
Sakakura

(10) Patent No.: US 11,938,386 B2
(45) Date of Patent: Mar. 26, 2024

(54) TEE PEG HOLDER

(71) Applicant: S.T.O Ltd, Mishima (JP)

(72) Inventor: Katsuyuki Sakakura, Mishima (JP)

(73) Assignee: S.T.O Ltd, Mishima (JP)

( * ) Notice: Subject to any disclaimer, the term of this patent is extended or adjusted under 35 U.S.C. 154(b) by 239 days.

(21) Appl. No.: 17/596,052

(22) PCT Filed: Jul. 16, 2021

(86) PCT No.: PCT/JP2021/026774
§ 371 (c)(1),
(2) Date: Dec. 2, 2021

(87) PCT Pub. No.: WO2023/286268
PCT Pub. Date: Jan. 19, 2023

(65) Prior Publication Data
US 2023/0158380 A1 May 25, 2023

(51) Int. Cl.
*A63B 57/20* (2015.01)
*A63B 55/00* (2015.01)

(52) U.S. Cl.
CPC ..... *A63B 57/203* (2015.10); *A63B 55/408* (2015.10)

(58) Field of Classification Search
CPC ..... A63B 55/408; A63B 55/57; A63B 57/203; A63B 57/20
See application file for complete search history.

(56) References Cited

U.S. PATENT DOCUMENTS 5,433,436 A * 7/1995 Hoyt ..... A63B 57/203 206/315.1
2002/0162866 A1* 11/2002 Hurtgam ..... A45F 5/00 224/684
2005/0236446 A1* 10/2005 Sims ..... A63B 57/0032 224/269
2020/0015517 A1 1/2020 Spektor

FOREIGN PATENT DOCUMENTS

| | | | |
|---|---|---|---|
| JP | 59-040875 | A | 3/1984 |
| JP | 2005-536294 | A | 12/2005 |
| JP | 3171188 | U | 10/2011 |
| JP | 3220487 | U | 3/2019 |
| KR | 10-0653918 | B1 | 12/2006 |
| KR | 10-0756733 | B1 | 9/2007 |
| WO | 2004/020051 | A1 | 3/2004 |

* cited by examiner

*Primary Examiner* — Bryon P Gehman
(74) *Attorney, Agent, or Firm* — Sughrue Mion, PLLC

(57) ABSTRACT

A tee peg holder is provided. The tee peg holder can be fixed to a fixation object, and a portion for holding tee pegs can be replaced easily. A clip 10 has a nipping portion 11 disposed at the tip end thereof and a plate support portion 13 disposed at a position behind the nipping portion 11. A holder plate 20 has two support notches 22 and a holder hole 21. When the holder plate 20 inserted in a plate insertion hole 14 of the plate support portion 13 is unbent, both end portions of the plate support portion 13 are inserted respectively in the support notches 22, thereby positioning and supporting the holder plate 20.

6 Claims, 5 Drawing Sheets

TEE PEG HOLDER

CROSS REFERENCE TO RELATED APPLICATIONS

This application is a National Stage of International Application No. PCT/JP2021/026774 filed Jul. 16, 2021.

TECHNICAL FIELD

The present disclosure relates to a tee peg holder configured to store tee pegs to be used for tee shots of golf and configured to be attached, for example, to a club head cover.

BACKGROUND ART

When a golfer do first shots in a golf course, the golfer adjusts the height of the ball position appropriately by using a tee peg and putting a ball on it.

The golfer uses the tee peg only for the first shots and keeps it, for example, in a pocket of a golf bag from the second shots on. The tee peg may be lost in some cases while the golfer plays around the course.

Since different tee pegs are used for long and short holes, the golfer normally brings multiple tee pegs including spare ones.

The golfer may use a tee holder for keeping tee pegs while playing around. A type of tee holder, for example, is configured to be attached to a golf cap or golf wear (see PTL 1). This tee holder includes a base member having a tubular body and a connection member mounted on the base member. For example, the connection member is a safety pin. When a user uses this tee holder, the user fixes the base member to an appropriate part of a golf cap or golf wear using the safety pin and inserts a tee peg into an opening of the tubular body.

Another type of tee holder has a base member having an appropriate elasticity (flexibility) and fitting holes formed therethrough and a nipping member, such as a clip, disposed on the base member (see PTL 2).

The base member of this tee holder is shaped like a fan and has multiple fitting holes formed from the top surface of the base member toward the bottom surface thereof. When a tee peg is inserted in a fitting hole, the fitting hole is formed so as to come into close contact with the tee peg and hold the tee peg elastically, thereby preventing the tee peg from coming off accidentally.

CITATION LIST

Patent Literature

[PTL 1] Japanese Registered Utility Model No. 3171188

[PTL 2] Japanese Unexamined Patent Application Publication No. 59-40875

SUMMARY OF INVENTION

Technical Problem

The known tee peg holders described above are formed such that the portion (such as a clip) to be fixed to golf wear or a golf bag is not easily separated from the portion that holds tee pegs.

In addition, these tee peg holders are configured to hold tee pegs inserted into the tubular members or the fitting holes. During the use of such a tee peg holder, a user repeats insertion and removal of tee pegs, which may damage the portion that holds the tee pegs.

Accordingly, such a tee peg holder needs to be replaced entirely with a new one even if only part of it is damaged.

The present disclosure provides a tee peg holder for holding tee pegs that can be fixed to a fixation object and that enables a portion for holding tee pegs to be easily replaced with another one.

Solution to Problem

A tee peg holder according to the present disclosure includes a clip that fixes the tee peg holder to a fixation object and a holder plate that is supported by the clip and has a holder hole to hold a tee peg. The clip has a nipping portion disposed at a tip end of the clip and configured to nip part of the fixation object. The clip also has a plate support portion disposed at a position behind the nipping portion and configured to support the holder plate. The holder plate is flexible and has one support notch and another support notch formed at respective opposite sides of the holder plate. The one support notch is formed from one side of the holder plate toward a center portion thereof, and the other support notch is formed from the other side of the holder plate toward the center portion thereof. The one support notch and the other support notch are arranged so as to oppose each other across the center portion. The plate support portion has a plate insertion hole through which the holder plate is inserted while the holder plate is bent. When the holder plate inserted in the plate insertion hole is unbent, support end portions of the plate support portion positioned at both ends of the plate insertion hole are inserted respectively in the one support notch and the other support notch and thereby position and support the holder plate.

A tee peg holder according to the present disclosure includes a clip that fixes the tee peg holder to a fixation object and a holder plate that is supported by the clip and has a holder hole to hold a tee peg. The clip has a nipping portion disposed at a tip end of the clip and configured to nip part of the fixation object. The clip also has a plate support portion disposed at a position behind the nipping portion and configured to support the holder plate. The holder plate has one support notch and another support notch formed at respective opposite sides of the holder plate. The one support notch is formed from one side of the holder plate toward a center portion thereof, and the other support notch is formed from the other side of the holder plate toward the center portion thereof. The one support notch and the other support notch are arranged so as to oppose each other across the center portion and so as not to have the holder hole formed therebetween. The plate support portion has a longitudinally extending support member at a rear end of the plate support portion in such a manner that the support member is openable at one longitudinal end thereof. When the support member is closed, an elongated plate insertion hole through which the holder plate is inserted is formed. After the holder plate is inserted in between the support member and the rear end of the plate support portion while the support member is open and subsequently the support member is closed, support end portions of the plate support portion, or two longitudinal end portions of the support member, that are positioned at both longitudinal ends of the plate insertion hole are inserted respectively in the one support notch and the other support notch and thereby position and support the holder plate.

In the tee peg holder, the holder plate may be made of hard silicone rubber, hard synthetic rubber, or hard resin.

In addition, in the tee peg holder, the one support notch and the other support notch formed in the holder plate may be separated such that when the two support end portions are inserted respectively in the one support notch and the other support notch and thereby position and support the holder plate, the one support notch and the other support notch press the two support end portions.

Advantageous Effects of Invention

According to the present disclosure, the tee peg holder holding tee pegs can be attached to a personal item, and a portion for holding tee pegs can be easily replaced with another one when the portion is damaged.

DESCRIPTION OF EMBODIMENTS

Now, embodiments of the present invention will be described.

First Embodiment

Figure 1:
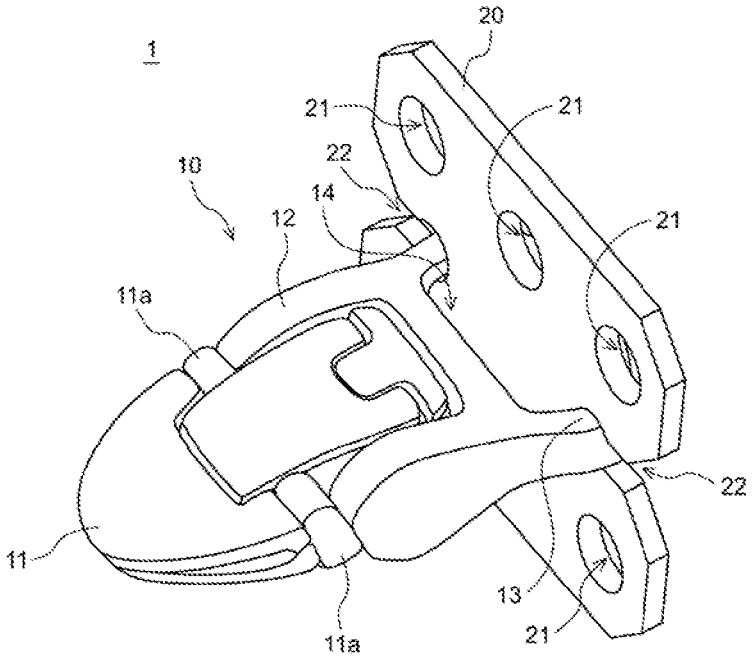
FIG. 1 is a perspective view illustrating a configuration of a tee peg holder according to a first embodiment of the present disclosure.

FIG. 1 is a perspective view illustrating a configuration of a tee peg holder 1 according to a first embodiment of the present disclosure. The tee peg holder 1 includes a clip 10 and a holder plate 20. The clip 10 detachably fixes the tee peg holder 1 to, for example, any part of a club head cover for a driver (golf club) or of a golf bag (hereinafter referred to as a "fixation object"). The holder plate 20 is positioned and supported by the clip 10 and serves to hold multiple tee pegs.

For example, the clip 10 is formed of a hard resin member not easily deformed and bent.

The holder plate 20 is made of a flexible material, for example, a sheet having an approximate thickness of 2 to 3 [mm] and being made of silicone rubber, synthetic rubber, or soft resin.

Figure 2:
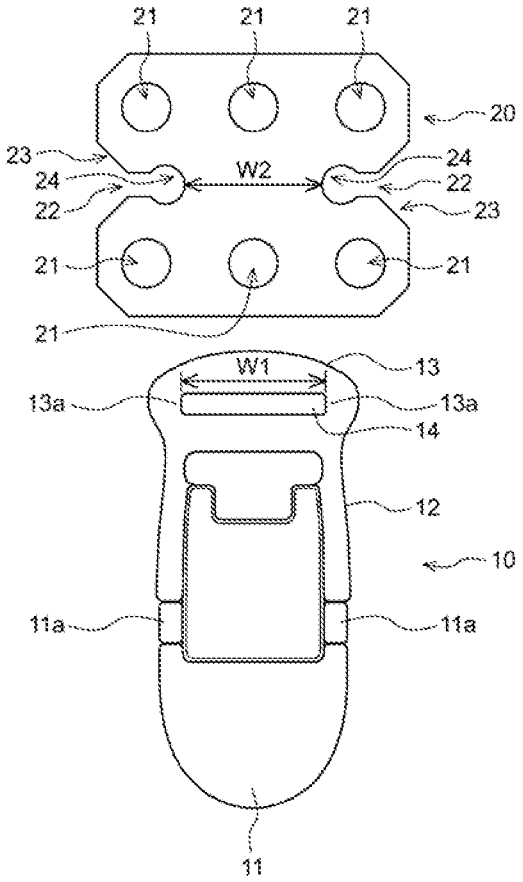
FIG. 2 is a diagram illustrating configurations of parts when a clip and a holder plate of FIG. 1 are separated from each other.

FIG. 2 is a diagram illustrating configurations of parts when the clip 10 and the holder plate 20 of FIG. 1 are separated from each other.

For example, the clip 10 includes a nipping portion 11 at a front portion thereof and a clip body 12 that supports the base end portion of the nipping portion 11.

For example, the base end portion of the nipping portion 11 is connected to (supported by) the clip body 12 using a shaft member (not illustrated) so that tip ends of the nipping portion 11 can open and close like scissors in the up-down direction in FIG. 1.

Urging portions 11*a* are disposed at the base end portion of the nipping portion 11. The urging portions 11*a* are configured, for example, such that when a user manipulates the clip body 12 in a way, the urging portions 11*a* urge the tip ends of the nipping portion 11 to close, and when the user manipulates the clip body 12 in another way, the tip ends of the nipping portion 11 assumes the opening position.

Alternatively, the urging portions 11*a* may be configured such that when a user manipulates the clip body 12 in a way, the urging portions 11*a* urge the tip ends of the nipping portion 11 to close, and when the user manipulates the clip body 12 in another way, the urging portions 11*a* cease to urge the nipping portion 11 so that the tip ends of the nipping portion 11 is allowed to open freely.

The urging portions 11*a* and the nipping portion 11 are formed at the end of the clip body 12 positioned near the tip end of the clip 10. The clip body 12 has a plate support portion 13 disposed at a rear end thereof behind the nipping portion 11 and the urging portions 11*a*.

For example, the clip body 12 includes a manipulation mechanism (not illustrated) that can switch the nipping portion 11 between the closing position and the opening position (or non-closing position) by pressing part of the clip body 12.

The plate support portion 13 has a plate insertion hole 14 through which the holder plate 20 is inserted.

The plate insertion hole 14 is an elongated hole formed in the plate support portion 13 at a position distant from the nipping portion 11. The elongated hole is formed so as to extend for a length W1 parallel to the width direction of the nipping portion 11.

The plate insertion hole 14 has a width equal to or slightly greater than the thickness of the holder plate 20.

As described above, the holder plate 20 is made of a flexible material such as silicone rubber, and the illustrated example has six holder holes 21.

For example, in the holder plate 20, three holder holes 21 are arranged in each of two rows, and support notches 22 are formed between the two rows of the holder holes 21. In FIG. 2, the lateral length of the holder plate 20 is larger than that of the clip 10.

Each holder hole 21 is a through hole having a diameter substantially equal to that of a tee peg. More specifically, the holder hole 21 is formed such that when a tee peg is inserted, the holder plate 20 made of the flexible material can hold the tee peg tight appropriately.

The holder hole 21 may be formed, for example, like a tapered shape so as to have a small diameter portion slightly narrower than the tee peg.

The support notches 22 are formed respectively at one side and the other side of the holder plate 20 that oppose each other. The support notches 22 are disposed so as to oppose each other. Each support notch 22 is cut from the corresponding side of the holder plate 20 toward the center thereof.

As described herein by way of example, each support notch 22 has a notch opening 23 that opens so as to become wider toward the side of the holder plate 20, which enables a user to insert the holder plate 20 easily into the plate insertion hole 14.

Note that the two support notches 22 are formed without having any holder hole 21 interposed therebetween.

When the holder plate 20 is positioned and supported by the clip body 12 (by the plate support portion 13), the portion of the holder plate 20 between the two support notches 22 abuts the plate support portion 13, which will be described later. Accordingly, the holder holes 21 are formed at positions outside the portion between the two support notches 22 so that a user can insert tee pegs 101 into the holder holes 21 in the state of the holder plate 20 being positioned and held by the clip body 12.

The width of each support notch 22 (length in the up-down direction in FIG. 2) is substantially equal to the depth of the plate insertion hole 14.

In addition, the support notch 22 has a notch bottom 24 at the bottom of the support notch 22, in other words, at the end of the support notch 22 near the center of the holder plate 20. The notch bottom 24 is formed like a circular hole slightly larger than the notch width, thereby preventing cracks from occurring at the support notch 22.

The plate support portion 13 has support end portions 13*a* near respective lateral ends thereof.

The support end portions 13*a* are disposed at respective longitudinal ends of the plate insertion hole 14. The two support end portions 13*a* are disposed at a distance W1 therebetween.

The holder plate 20 has the two support notches 22 formed at a distance W2 therebetween so as to enable the two notch bottoms 24 to abut respective support end portions 13*a* when the holder plate 20 is inserted into the plate insertion hole 14.

The distance W2 is substantially equal to the length W1 of the plate insertion hole 14. Note that the distance between the two notch bottoms 24 (distance between the support notches 22) is such that the support notches 22 can abut respective support end portions 13*a* (i.e., abut hole walls at the longitudinal ends of the plate insertion hole 14) when the holder plate 20 is inserted into the plate insertion hole 14.

In other words, the holder plate 20 is formed such that the side edges of the support notches 22 can abut the plate support portion 13.

In addition, the holder plate 20 is formed such that portions having the holder holes 21 are longer than the plate insertion hole 14. Accordingly, the portions having the holder holes 21 cannot pass easily through the plate insertion hole 14 compared with the portion between the two support notches 22.

Next, a procedure to attach the holder plate 20 to the clip 10 will be described.

When the holder plate 20 is inserted into the plate insertion hole 14 of FIG. 2, a user first inserts, for example, one of the corner portions of the holder plate 20 into the plate insertion hole 14.

Here, the user inserts the holder plate 20 into the plate insertion hole 14 in such a manner that one of the support end portions 13*a* is inserted into one of the notch openings 23 and subsequently moved to one of the notch bottoms 24.

Next, the user bends the holder plate 20 (for example, bends the holder plate 20 so as to compress the portion between the two support notches 22) and thereby inserts the other support end portion 13*a* into the other notch opening 23.

Subsequently, the user inserts the holder plate 20 further into the plate insertion hole 14 in such a manner that the other support end portion 13*a* inserted in the other notch opening 23 is moved to the other notch bottom 24. When the user moves the other support end portion 13*a* to the other notch bottom 24, the user inserts the holder plate 20 further into the plate insertion hole 14 so as to unbend the holder plate 20, which causes the plate support portion 13 to position and support the portion between the two support notches 22 of the holder plate 20.

When the holder plate 20 is held by the plate support portion 13, the support notches 22 of the holder plate 20 appropriately press respective ones of the two support end portions 13*a* positioned at both longitudinal ends of the plate support portion 13.

The pressure generated here stabilizes the holder plate 20 relative to the clip body 12 so as to prevent displacement when, for example, the user mounts tee pegs onto the holder plate 20 or removes them. In other words, the distance between the two support notches 22 is set so as to generate such pressure when the holder plate 20 is positioned and held by the clip body 12.

Note that when the user removes the holder plate 20 from the plate support portion 13, the user simply reverses the above procedure.

Figure 3:
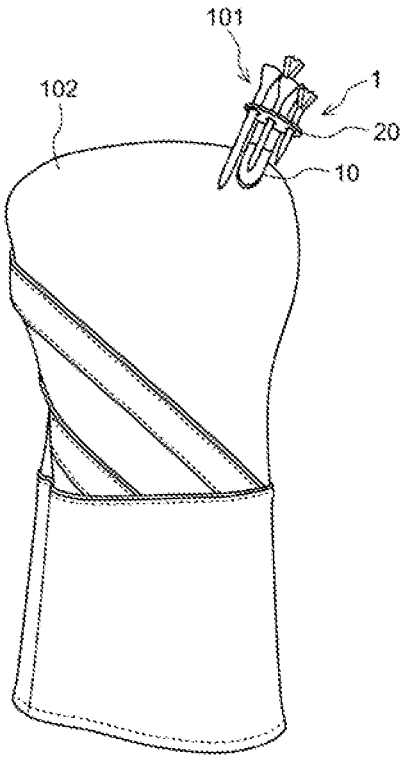
FIG. 3 is a diagram illustrating a state in which the tee peg holder of FIG. 1 is attached to a club head cover.

FIG. 3 is a diagram illustrating a state in which the tee peg holder 1 of FIG. 1 is attached to a club head cover 102. In this example, the holder plate 20 holds multiple tee pegs 101 and the clip 10 is fixed to a club head cover 102 for a driver.

When a user fixes the tee peg holder 1 to the head cover 102, for example, the user manipulates the clip body 12 in the above-described way and closes the nipping portion 11 to nip an appropriate portion of the head cover 102. The user can insert an appropriate number of tee pegs 101 into the holder plate 20 of the tee peg holder 1.

If the tee peg holder 1 is attached to the head cover 102 of a driver as described above, the user can find a tee peg easily when the driver is used and also can reduce the likelihood of losing tee pegs.

In addition to the head cover 102, the tee peg holder 1 can be attached to any item, such as an edge of a golfer's cap or a pocket, a belt, or a golf bag (or other golfer's items).

Figure 4:
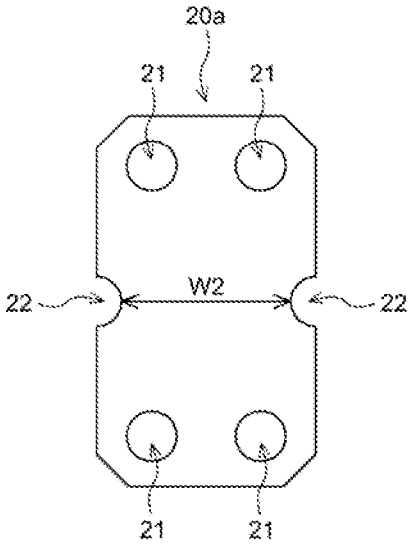
FIG. 4 is a diagram illustrating another configuration of the holder plate to be positioned and supported by the clip.

FIG. 4 is a diagram illustrating a configuration of a holder plate 20*a* to be positioned and supported by the clip 10. In place of the holder plate 20, the tee peg holder 1 may use a holder plate 20*a* to be fixed to the clip 10.

For example, the holder plate 20*a* is made of a flexible material such as silicone rubber as is the holder plate 20. The example illustrated in FIG. 4 has four holder holes 21. Note that the holder holes 21 formed in the holder plate 20*a* have the same size and shape as those formed in the holder plate 20.

In the holder plate 20*a*, two holder holes 21 are arranged in each of two rows, and support notches 22 are formed between the two rows of the holder holes 21.

The support notches 22 are disposed in the holder plate 20*a* at a distance W2 therebetween as is the case for the holder plate 20. Accordingly, the portion of the holder plate 20*a* between the two support notches 22 can be inserted into the plate insertion hole 14 of the clip body 12, and the holder plate 20*a* is thereby positioned and supported by the plate support portion 13 as is the case for the holder plate 20.

The holder plate 20*a* is formed so as to have a lateral length smaller than that of the holder plate 20. Two holder holes 21 are arranged side by side in the lateral direction in the upper row and also in the lower row.

As described, the support notches 22 are disposed in the holder plate 20*a* at a distance W2 therebetween. The holder plate 20*a* has a smaller lateral width, and the support notches 22 are formed without the notch openings 23 and the notch bottoms 24. The support notches 22 are shaped semicircularly, in other words, depressed semicircularly from side edges of the holder plate 20*a* toward the center thereof.

The tee peg holder 1 equipped with the holder plate 20*a* is convenient for holding a smaller number of tee pegs 101.

The holder plate 20*a* has a lateral width smaller than that of the holder plate 20, which facilitates mounting and removal of the holder plate 20*a* onto and from the plate support portion 13 of the clip 10.

The holder plate of the tee peg holder 1 is not limited to the holder plate 20 having six holder holes 21 nor to the holder plate 20*a* having four holder holes 21, but may be another holder plate having a different number of holder holes 21.

Note that even in the case of the holder plate 20 of the tee peg holder 1 having any number of holder holes 21, the holder plate 20 has the above-described support notches 22 and is configured to be inserted into the plate insertion hole 14 and thereby positioned and supported by the plate support portion 13.

Second Embodiment

Figure 5:
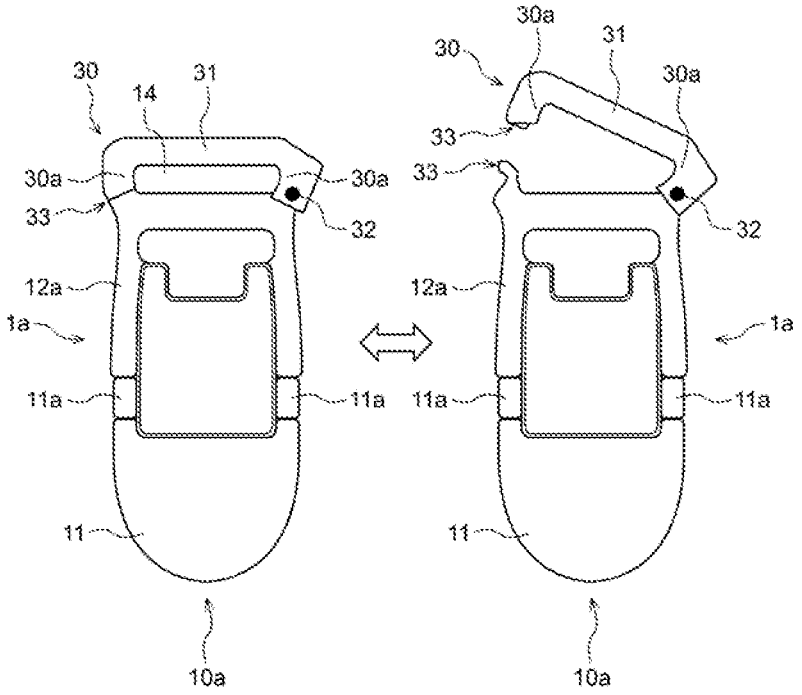
FIG. 5 is a diagram illustrating a configuration of a clip of a tee peg holder according to a second embodiment of the present disclosure.

FIG. 5 is a diagram illustrating a configuration of a clip 10*a* of a tee peg holder 1*a* according to a second embodiment of the present disclosure. The tee peg holder 1*a* of the second embodiment has the clip 10*a* as illustrated in FIG. 5 and a holder plate, such as the holder plate 20 illustrated in FIG. 2 or the holder plate 20*a* illustrated in FIG. 4. The holder plate is to be attached to the clip 10*a*. The holder plate 20 and the holder plate 20*a* are already described in the first embodiment, and duplicated descriptions of elements similar to those already described will be omitted.

The tee peg holder 1*a* has the nipping portion 11 and the urging portions 11*a* or the like disposed in a front portion of a clip body 12*a* (a portion near the tip end of the clip 10*a*). The nipping portion 11 and the urging portions 11*a* are configured similarly to those of the tee peg holder 1.

As is the case for the clip body 12, the clip body 12*a* includes, for example, the manipulation mechanism (not illustrated) that can switch the nipping portion 11 between the closing position and the opening position (or non-closing position) by pressing part of the clip body 12*a*.

The clip body 12*a* has a plate support portion 30 at a rear end of the clip body 12*a* (as a rear portion behind the nipping portion 11 and others). For example, the plate support portion 30 opens at one of the side ends (a first side end) of the clip body 12*a*. The plate support portion 30 is formed of a support member 31 and also of a rear portion of the clip body 12*a*.

As illustrated in the left figure of FIG. 5, the support member 31 and the rear portion of the clip body 12*a* are shaped so as form the plate insertion hole 14 when the support member 31 is closed, in other words, when the support member 31 is fixed to the rear portion of the clip body 12*a*. This plate insertion hole 14 has the same shape and size as that of the plate insertion hole 14 described in the first embodiment.

An opening/closing support 32 is formed at a second side end of the clip body 12*a* in the rear end portion of the clip body 12*a* (at the right end of the plate support portion 30 in FIG. 5). The opening/closing support 32 pivotally supports a second side end of the support member 31 so as to enable the support member 31 to move rotatably.

A support member fixation portion 33 is formed at a first side end of the support member 31 and also at a first side end of the clip body 12*a* in the rear end portion of the clip body 12*a* (at the left end of the plate support portion 30 in FIG. 5).

The support member fixation portion 33 is shaped so as to enable the first side end of the support member 31 to be latched on (engaged with) the second side end of the clip body 12*a* in the rear end portion thereof. Accordingly, a user can unlatch the support member fixation portion 33, for example, by bending the support member 31 by finger.

For example, when the holder plate 20 is positioned and held by the clip 10*a*, a user opens the support member 31 as illustrated in the right figure of FIG. 5 (in the state of the support member fixation portion 33 being unlatched) and inserts the holder plate 20 from the opening.

Here, the user inserts the holder plate 20 in between the support member 31 and the rear end portion of the clip body 12*a* in such a manner that the two support notches 22 of the holder plate 20 abut respective support end portions 30*a* positioned at opposite longitudinal ends of the support member 31 (opposite end portions of the plate support portion 30 in the longitudinal direction thereof).

After the holder plate 20 is inserted, the user closes the support member 31 by latching the support member fixation portion 33 as illustrated in the left figure of FIG. 5.

When the support member 31 is closed, the support member 31 maintains the state of the holder plate 20 being accommodated in the plate insertion hole 14 and positioned and supported relative to the clip body 12*a*.

When the holder plate 20 is held by the plate support portion 30, the support notches 22 of the holder plate 20 appropriately press respective ones of the two support end portions 30*a* of the support member 31 positioned at both longitudinal ends thereof (both ends of the plate support portion 30 in the longitudinal direction).

The pressure generated stabilizes the holder plate 20 so as to prevent displacement of the holder plate 20 relative to the clip body 12*a* when, for example, the user mounts tee pegs 101 or the like onto the holder plate 20 or removes them.

In other words, the distance between the two support notches 22 is set so as to generate such pressure when the holder plate 20 (holder plate 20*a*) is positioned and held by the clip body 12*a*.

When the holder plate 20 is detached from the clip body 12*a*, for example, a user unlatches the support member fixation portion 33 and opens the support member 31 and takes out the holder plate 20 from the plate insertion hole 14.

Note that the clip body 12*a* is configured such that a user can mount and remove the holder plate 20*a* of FIG. 4 in the same manner as the holder plate 20.

In the tee peg holder 1*a*, when a user attaches or detaches the holder plate 20 or 20*a* to and from the clip body 12*a*, the support member 31 can open, which eliminates the necessity of bending the holder plate 20 largely.

The holder plate 20 or 20*a* of the tee peg holder 1*a* may be made of not only a flexible material but also a material harder than this. In other words, the tee peg holder 1*a* can use a holder plate 20 or 20*a* made of a silicone rubber, a synthetic rubber, or a resin that are harder than those for the holder plate 20 or 20*a* in the first embodiment.

Note that even if the holder plate 20 or 20*a* of the tee peg holder 1*a* is made of the above-described hard material, the holder plate 20 or 20*a* has the holder holes 21 configured to hold tee pegs 101 as described in the first embodiment. More specifically, in order to hold the tee peg 101 tightly, each holder hole 21 of the holder plate 20 or 20*a* is formed, for example, like a tapered hole in which the hole-edge portion becomes thinner so as to impart flexibility (elasticity) to the hole-edge portion.

As described above, the tee peg holder 1 or 1*a* of the present disclosure enables a user to attach and detach the holder plate 20 or 20*a* for holding tee pegs 101 to and from the clip 10 or 10*a* appropriately. Consequently, the holder plate can be replaced according to the number of tee pegs to be used or replaced with a new one when the holder plate is damaged.

REFERENCE SIGNS LIST

1, 1*a* tee peg holder
10, 10*a* clip
11 nipping portion
11*a* urging portion
12, 12*a* clip body
13, 30 plate support portion
13*a*, 30*a* support end portion
14 plate insertion hole
20, 20*a* holder plate
21 holder hole
22 support notch
23 notch opening
24 notch bottom
31 support member
32 opening/closing support
33 support member fixation portion
101 tee peg
102 head cover

The invention claimed is:

1. A tee peg holder comprising:

a clip that fixes the tee peg holder to a fixation object; and a holder plate that is supported by the clip and has a holder hole to hold a tee peg, wherein the clip has a nipping portion disposed at a tip end of the clip and configured to nip part of the fixation object, and a plate support portion disposed at a position opposite to the nipping portion and configured to support the holder plate, the holder plate is flexible and has one support notch and another support notch formed at respective opposite sides of the holder plate, the one support notch being formed from one side of the holder plate toward a center portion thereof, the other support notch being formed from the other side of the holder plate toward the center portion thereof, the one support notch and the other support notch being arranged so as to oppose each other across the center portion, the plate support portion has a plate insertion hole through which the holder plate is inserted while the holder plate is bent, and when the holder plate inserted in the plate insertion hole is unbent, support end portions of the plate support portion positioned at both ends of the plate insertion hole are inserted respectively in the one support notch and the other support notch and thereby position and support the holder plate.

2. The tee peg holder according to claim 1, wherein the one support notch and the other support notch formed in the holder plate are separated such that when the two support end portions are inserted respectively in the one support notch and the other support notch and thereby position and support the holder plate, the one support notch and the other support notch press the two support end portions.

3. The tee peg holder according to claim 1, wherein the one support notch and the other support notch formed in the holder plate are separated such that when the two support end portions are inserted respectively in the one support notch and the other support notch and thereby position and support the holder plate, the one support notch and the other support notch press the two support end portions.

4. The tee peg holder according to claim 1, wherein the holder plate is made of hard silicone rubber.

5. The tee peg holder according to claim 1, wherein the holder plate is made of hard synthetic rubber.

6. The tee peg holder according to claim 1, wherein the holder plate is made of hard resin.

* * * * *